United States Patent [19]

Eskijian

[11] Patent Number: 4,716,053

[45] Date of Patent: Dec. 29, 1987

[54] TUBING COATING DEVICE AND METHOD

[76] Inventor: Luther Eskijian, 2223 Midlothian Dr., Altadena, Calif. 91001

[21] Appl. No.: 833,341

[22] Filed: Feb. 26, 1986

[51] Int. Cl.[4] ..... B05D 7/22

[52] U.S. Cl. ..... 427/230; 118/408; 118/DIG. 10

[58] Field of Search ..... 427/230; 118/DIG. 10, 118/408

[56] References Cited

U.S. PATENT DOCUMENTS

| | | | |
|---|---|---|---|
| 2,950,702 | 8/1960 | Ferguson et al. | 427/230 |
| 2,951,255 | 9/1960 | Ver Nooy | 118/DIG. 10 |
| 3,055,339 | 9/1962 | Distole et al. | 118/DIG. 10 |
| 3,108,024 | 10/1963 | Battle | 118/DIG. 10 |
| 3,111,431 | 11/1963 | Weaver | 118/DIG. 10 |
| 3,118,791 | 1/1964 | McLean | 118/DIG. 10 |
| 3,125,464 | 3/1964 | Harmes | 118/DIG. 10 |
| 3,322,559 | 5/1967 | Eskijian | 427/230 |
| 4,602,974 | 7/1986 | Wood et al. | 427/230 |

*Primary Examiner*—Janyce A. Bell

*Attorney, Agent, or Firm*—William W. Haefliger

[57] ABSTRACT

The method of coating viscous material onto coaxial bores of different diameters, that includes:

(a) inserting an expansible and contractible element into said bores, (b) locating viscous material in said bores to be be retracted by said element, (c) retracting said element to effect retraction of said viscous material, and also controlling the diameter of said element, including decreasing its diameter as the element passes into a bore of reduced diameter, so as to spread said viscous material in the form of a tubular layer onto said bores, and while the element passes through the spread tubular layer.

20 Claims, 8 Drawing Figures

8
8

TUBING COATING DEVICE AND METHOD

BACKGROUND OF THE INVENTION

This invention relates generally to coating tubing bores; and more particularly concerns coating tubing bores of varying diameters.

U.S. Pat. No. 3,322,559 (incorporated herein by reference) discloses a method of coating the interiors of constant diameter tubes, at and near the ends thereof. There is need for apparatus and method to coating tubing of variable diameters, as for example condenser tubes having protective insert tubes terminating therein, the insert tubes having inner tubes terminating therein, the insert tubes having inner diameters less than the inner diameters of the condenser tubes. Such insert sleeves (or tubes) are used to cover damaged or cavitated areas of condenser, the critical area being the transition between the two diameters of the sleeve and condenser tube, whereby coating same is desirable. Such coatings act to prolong the lives of the condenser tubes and insert sleeves, and such coatings prolong the uses of the tubes. In this regard, the cost of changing condenser tubes in electric generating plants is extremely high, so that extending tube useful life is very desirable.

SUMMARY OF THE INVENTION

It is a major object of the invention to provide method and apparatus meeting the above need. Basically, the method of the invention is applicable to an outer tube and an insert sleeve therein, and includes the steps:

(a) inserting a distortable sealing element forwardly within the bore of the outer tube and to a position proximate the inserted end of the insert sleeve, and also locating a plunger within the insert sleeve, with a viscous material on the surface of the plunger.

(b) advancing a pusher forwardly on the plunger to push said viscous material toward and proximate said element and proximate said end of the insert sleeve, (c) distorting said element to engage the bore of the outer tube, and also squeezing the viscous material against the bores of the sleeve and tube proximate said end of the insert sleeve tubing, thus providing protection at the most critical transition area where cavitation and corrosion occurs, (d) and contracting said element away from the bore of the outer tube and withdrawing the contracted element and pusher rearwardly from the tubes.

As will appear, the distortable or expansible element may be inserted on a shaft projecting endwise from the plunger, and step (d) expansion may be carried out in response to causing endwise relative displacement between the shaft and plunger; and such relative displacement may be quickly effected by hand operated cam mechanism as will appear.

It is another object of the invention to provide for controlled coating of the different bore diameters as the expansible element is withdrawn from the tubing. Such controlled cotaing may be effected by effecting retraction of the mass of coating material by means of withdrawal of the expansible element, and also controllaby the diameter of said element, including decreasing its diameter as the element passes into a bore of reduced diameter, so as to spread said viscous material in the form of a tubular layer onto said bores, and while the element passes through the spread tubular layer. To this end, the expansible element may be reduced in diameter as it enters an insert sleeve, and maintaining it in partially expanded condition during said withdrawing step, thereby to effect applicaton of the coating of the viscous material to the bore of the insert sleeve.

These and other objects and advantages of the invention, as well as the details of an illustrative embodiment, will be more fully understood from the following specification and drawings, in which:

DRAWING DESCRIPTION

DETAILED DESCRIPTION

Figures 1, 2, 3:
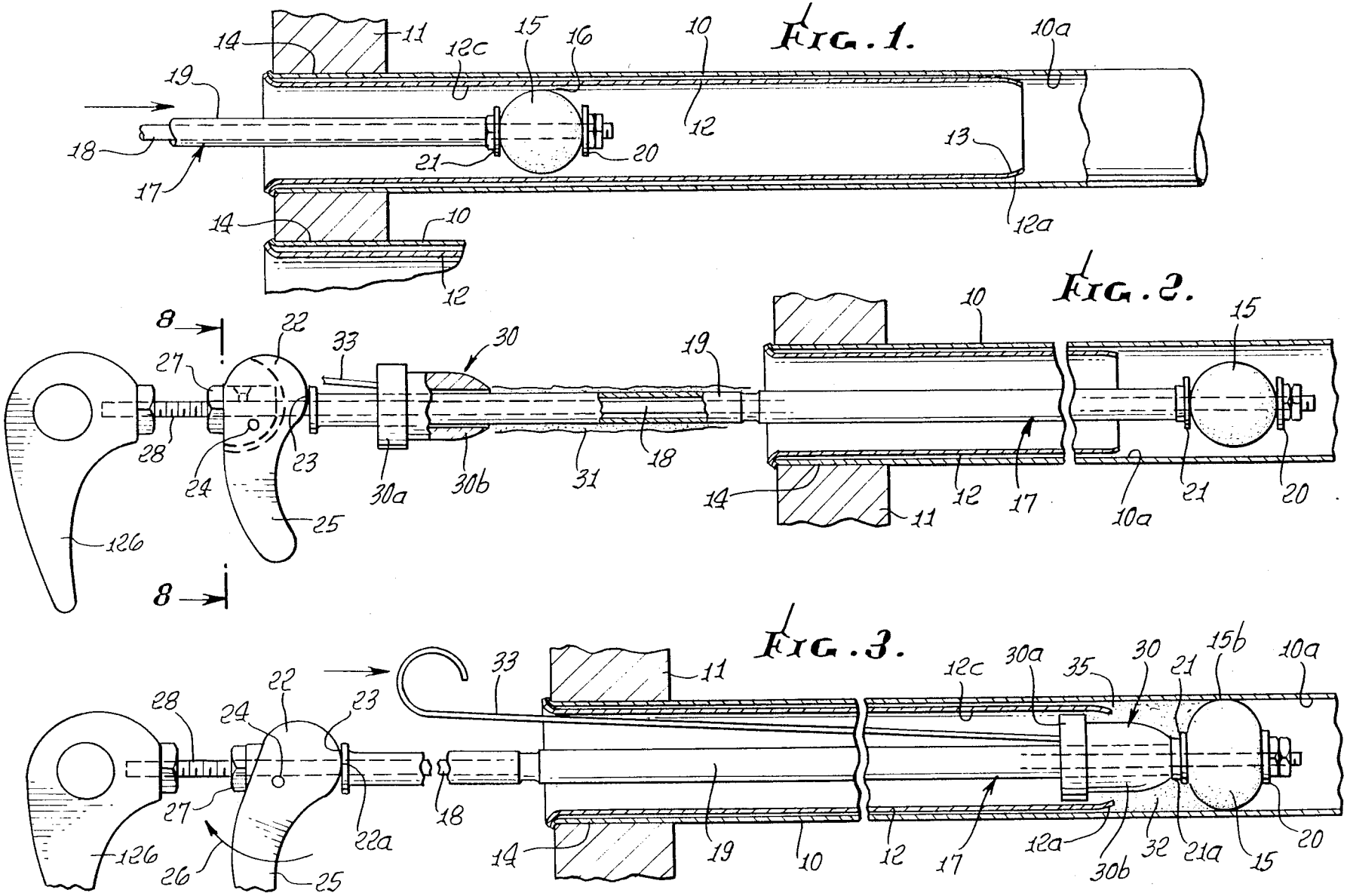
FIG. 1 is a sectional side elevation showing a boiler tube, and a sleeve tube, and insertion of a sealing element into the tubes.
FIG. 2 is a view like FIG. 1, but showing a pusher #30 being advanced forwardly on a plunger to push viscous material on the plunger toward the sealing element.
FIG. 3 is a view like FIG. 2 and showing completed displacement of viscous material to the proximity of the end of the insert sleeve, and expansion of the sealing element.

Referring to FIG. 1 condenser tubes are shown at 10 attached at 14 to a header plate 11; and protective insert sleeves 12 are located in the condenser tubes, near the ends. The terminal of an insert sleeve appears at 12*a*, and it may be turned inwardly as shown, to define a reducer diameter end opening 13. An expansible sealing element 15 is shown being inserted and advanced forwardly within sleeve 12, with clearance at 16 between the ball-like element 15 and the bore 12*c* of sleeve 12. The element 15 is shown as carried by and at the end of a plunger 17 which is also inserted into sleeve 12 and advanced therein. Element 15 may consist of a hollow elastomeric ball, resiliently expansible. The term "expansible" is used to refer to outward or radial distortion, relative to the sleeve, or to the axis of the plunger.

The plunger typically includes a shaft 18 and a plunger sleeve 19 on the shaft, and the element 15 is carried on the end portion of the shaft projecting from the insert sleeve. Controlled expansion of the element 15 is effected by controlled relative displacement of the shaft and sleeve 19 to variably squeeze the resilient, elastomeric element 15, as between washer 20 on shaft 18, and washer 21 on sleeve 19, as shown. The unexpanded ball 15 has a spherical diameter slightly smaller than the diameter of opening 13, so as to pass through same to FIG. 2 position, within the bore 10*a* of tube 10, and near the opening 13.

FIG. 2 also shows a means for effecting such relative displacement between shaft 18 and sleeve 19. It includes a cam 22 on the shaft (for example) and a cammed end surface 23 on the sleeve 19. The cam is pivotally supported as at 24, and has a handle 25 to be manually pulled in the direction of arrow 26, to cause progressive engagement of the cam surface 22*a* with surface 23, to displace the sleeve toward the ball 15, to compress and expand same, controllably, controlling the shape of the ball after surface 15*b* engages the bore in which it lies. A gripper 126 is provided on the shaft for hand gripping, while the user's fingers grip and press the handle, to rotate the cam. Pivot 24 is suitably supported at 24*a*, by the shaft. A nut 27 on a threaded portion 28 of the shaft may be rotated to adjustably displace the pivot support 24*a* along the shaft.

Figure 4:
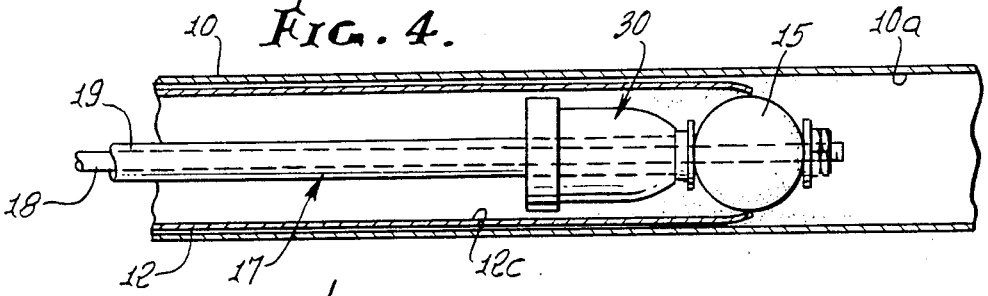
FIG. 4 is a view like FIG. 3 showing initial retraction of the now non-expanded sealing element.

Prior to squeezing of the ball 15, a pusher 30 is advanced forwardly on the plunger sleeve 19 to push viscous sealing material 31 on the plunger slleve surface toward the ball 15. See that material displayed along the sleeve, in FIG. 2. In FIG. 3, the plunger has been advanced to the right to push the viscous material into a zone at 32, proximate and covering the terminal 12*a* of the insert 12, extending at both inner and outer sides of the terminal, as shown. At this time, the ball has been expanded against bore 10*a* to confine the viscous material to the left of the ball, in FIG. 3. Material 31 typically consists of epoxide. A rod 33 may be employed to dispalce the pusher rightwardly, as shown in FIG. 3. Pusher 30 has a piston portion 30*a* with annular diameter slightly less than that of bore 12*c*, and a reduced diameter nose portion 30*b* that passes through opening 13 and engages the base 21*a* of washer 21. Accordingly, material 31 is squeezed in the position of FIG. 3, to enter between the terminal 12*c* and bore 10*a*, as at 35. As the material cures, it seals off completely about the end 12*a* of the insert sleeve, and with the bore 10. Prior to such curing, the element 15 is retracted radially inwardly away from bore 10, and withdrawn to the left through opening 13, and leftwardly within bore 12*c*, as appears in FIG. 4. Such withdrawal is effected by corresponding withdrawal of the plunger 17, the pusher 30 also being withdrawn, by engagement with washer 21.

Figure 5:
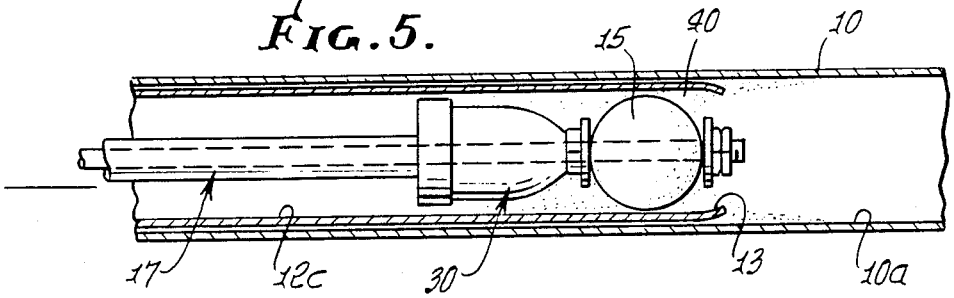
FIG. 5 is a view like FIG. 4 showing continued retraction of the sealing element.
Figure 6:
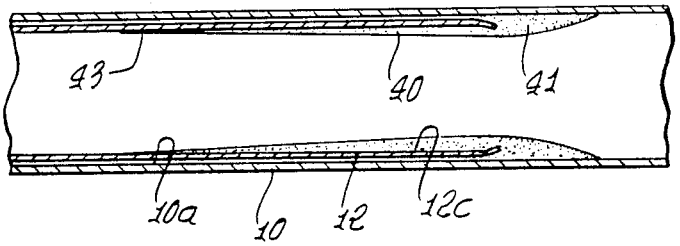
FIG. 6 is a sectional elevation showing resultant coating of viscous material onto the bores of the insert sleeve, the terminal of the insert sleeve, and the bore of the condenser tube proximate the terminal of the insert tube.

In FIG. 5, the ball 15 has passed through the opening 13, and is again compressed axially (by rotation of cam 22) to partially expand the ball radially, but not to engage bore 12*c*. The expansion is such as to leave a clearance equal to the thickness of viscous material to be deposited as a tubular layer 40 of controlled thickness on bore 12*c*, as the ball 15 and plunger 17 are retracted to the left. This leaves the insert sleeve junction, with outer tube 10*a* completely sealed, as by layer 40 and sealing material 41, at the tube end. See FIG. 6. Layer 40 may diminish as the viscous material is used up during withdrawal of the ball and plunger. See diminished zone 43.

Accordingly, the invention also embraces the method (a) inserting an expansible and contractible element 15 into said bores, 12*c* and 10*a*.

(b) advancing viscous material 41 in said bores to be retracted by said element, (c) retracting said element to effect retraction of said viscous material, and also controlling the diameter of said element, including decreasing it diameter as the element passes into a bore of reduced diameter, so as to spread said viscous material in the form of a tubular layer onto said bores, and while the element passes through the spread tubular layer.

A specific example is as follows:

Blow out any remaining water in the tube, from its former operation. Heat generally, so that condensation will not take place prior to the beginning of the sealing operation. Sand blast at 360° (radial interior of area) the critical area that is to be coated. Blow out the dust, using moisture free compressed air. Start sealing operation as described above.

There are several functions that have to be mastered at the same time, the first being to: stop all flow of sealing material, past the area that is to be coated, then the delivery to the desired location, and next the change of diameter as the ball 15 transcends across the two different interior diameters, and then pull out the entire apparatus, while wiping clean the remainder of the tube during pull out.

All steps are to be carried out in such a manner, that the material thickness or deposit 40 is not emplaced in an uneven manner, which could cause additional cavitation. Therefore, the beginning coating is very smooth and even transition; otherwise there would be lifting of the coating, particularly at the discharge end of the tube.

The entire apparatus is controllable, to meet all of these conditions, with the combining of the trigger cam control with one hand, and applied pressure upon the plunger (pig) with the other hand to get the material to the desired location, then releasing the pressure on the variable rubber ball plunger as it is pulled out.

The material delivery system is unique in that the outer or plunger sleeve 19 becomes the pick-up conveyor 30 of the material 31. When the shaft 17 is out (barely placed into position) the operation places the coating material 31 on the sleeve 19 as he pushes it into position. It thus becomes a conveyor. Then the pressure is placed upon the rubber or variable plunger 30 to make sure that nothing passes the desired area. Then the pressure rod 33 is inserted against the pressure plunger or (pig) into position, and then the rod 33 can be removed to facilitate the process of changing ball 15 diameters and pulling out the entire apparatus at one time. There may be an indicator on the outer plunger sleeve 19, showing just how far it is to be inserted into the tube 10. The material is totally encompassed between 15 and 30 as the process starts. The viscosity of the material is such, so that when the pressure is released from the rod, the material will not sag in the few seconds that are involved.

In the removal process, the pressure on the rubber or variable ball 15 is released sufficiently, so that material is deposited at the point of bore transition, and then the ball diameter is increased as it is withdrawn so as not to add or coat material, more than necessary, on the bore 12*c* of the insert-sleeve (this is usually of stainless steel, and need not be protected). Relocate the apparatus into the next tube and repeat the process, cleaning the equipment as necessary.

Figure 7:
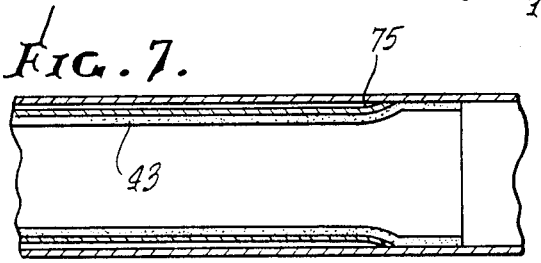
FIG. 7 is a view like FIG. 6 showing a modified insert sleeve.

The plunger 20 pig 30 can be so configured, as to allow for uplift for flaring of insert sleeve ends, as at 75 in FIG. 7, which reduces the diameter of the plunger, to where material may ooze (escape) past the plunger, rather than having the pressure to push the materials into position. In many cases this may not be necessary.

The material 31 may consist of epoxy resin, as described in U.S. Pat. No. 3,322,559, or other suitable sealant.

Figure 8:
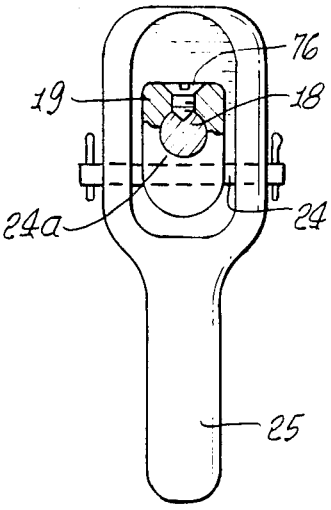
FIG. 8 is an end view on lines 8—8 of FIG. 2.

FIG. 8 shows a set screw 76 mounted in sleeve 19, and rotatable to clamp into the thread grooving on shaft 18, for temporarily holding the sleeve in any position, relative to the shaft.

I claim:

1. The method of applying a coating of viscous material to bores of an outer tube and of an insert tube, and proximate the inserted end of the insert tube, the steps including:

(a) inserting a sealing element forwardly within the bore of the outer tube and to a position proximate said inserted end of the insert tube, and also locating a plunger within said insert tube, with said viscous material on the surface of the plunger, and the sealing element carried on the plunger, (b) advancing a pusher forwardly on the plunger to push said viscous material toward and proximate said sealing element and proximate said end of the insert tube, (c) distorting said sealing element to engage the bore of the outer tube, and also squeezing said viscous material against the bores of the tubes proximate said end of the insert tubing, (d) and causing said element to more away from the bore of the outer tube and withdrawing the element and pusher rearwardly from the tubes.

2. The method of claim 1 including also pushing the pusher to establish a seal with the bore of the insert tube during said step (c) advancement.

3. The method of claim 1 wherein the plunger includes a shaft and a sleeve thereon, the element carried on the shaft projecting endwise from said sleeve, and said step expansion (c) distortion is effected in response to causing relative endwise displacement between said shaft and said sleeve.

4. The method of claim 3 including a cam on one of the shaft and sleeve, and a cammed surface on the other of the shaft and sleeve, and wherein said causing of relative displacement is carried out by progressively urging the cam against the cammed surface.

5. The method of claim 4 wherein said cam is pivotally supported, and is manually pivoted progressively against said cam surface.

6. The method of claim 1 wherein said viscous material consists essentially of epoxide cement.

7. The method of claim 1 including partially distorting said element toward the bore of the insert, and maintaining it in partially distorted condition during said withdrawing step, thereby to effect application of the coating of the viscous material to the bore of the insert tube.

8. The method of claim 5 wherein a handle is provided on the cam to be displaced by the user's fingers.

9. The method of claim 8 wherein a gripper is provided on said one of the shaft and sleeve to be manually held during said finger displacement of the handle on the cam.

10. The method of coating viscous material onto bores of different diameters, that includes:

(a) inserting a distortable element into said bores, (b) locating viscous material in said bores to be retracted by said element, (c) retracting said element to effect retraction of said viscous material, and also controlling the diameter of said element, including decreasing its diameter as the element passes into a bore of reduced diameter, so as to spread said viscous material in the form of a tubular layer onto said bores, and while the element passes through the spread tubular layer.

11. The method of claim 1 including temporarily locking the sleeve on the shaft.

12. In apparatus for applying coating of viscous material to bores of an outer tube and of an insert tube, and proximate the inserted end of the insert tube, the combination including:

(a) plunger means and a distortable sealing element carried thereon to be inserted forwardly within the bore of the outer tube and to carry said element to a position proximate said inserted end of the insert tube, whereby viscous material may be located on the surface of the plunger, (b) a pusher carried to be advanced forwardly on the plunger to push said viscous material toward and proximate said element and proximate said end of the insert tube, (c) means for distorting said element to engage the bore of the outer tube, enabling confinement of said viscous material against the bores of the tubes proximate said end of the insert tubing, and for allowing contracting of said element away from the bore of the outer tube and withdrawal the contracted element and pusher rearwardly from the tubes.

13. The apparatus of claim 12 including also means for pushing the pusher on and along the plunger to displace said material and to establish a seal with the bore of the insert tube during said step (b) advancement.

14. The apparatus of claim 12 wherein the plunger includes a shaft and a sleeve thereon, the sealing element carried on the shaft projecting endwise from said sleeve, and said distortion accompanied by relative endwise diplacement between said shaft and said sleeve.

15. The apparatus of claim 14 including a cam on one of the shaft and sleeve, and a cammed surface on the other of the shaft and sleeve, and wherein said relative displacement is carried out by progressively urging the cam against the cammed surface.

16. The apparatus of claim 15 wherein said cam is pivotally supported on the plunger to be manually pivoted, progressively, against said cam surface.

17. The method of claim 12 wherein said viscous material consists essentially of epoxide cement.

18. The apparatus of claim 12 wherein said element is partially distorted toward the bore of the insert during said withdrawing step, thereby to effect application of the coating of the viscous material to the bore of the insert tube.

19. The apparatus of claim 16 wherein a handle is provided on the cam to be displaced by the user's fingers.

20. The apparatus of claim 19 wherein a gripper is provided on said one of the shaft and sleeve to be manually held during said finger displacement of the handle on the cam.

* * * * *